US007318625B2

(12) United States Patent
Roither

(10) Patent No.: US 7,318,625 B2
(45) Date of Patent: Jan. 15, 2008

(54) RECLINING ELEMENT

(75) Inventor: Andreas Roither, Enger (DE)

(73) Assignee: Dewert Antriebs- und Systemtechnik GmbH & Co. KG, Kirchlengern (DE)

( * ) Notice: Subject to any disclaimer, the term of this patent is extended or adjusted under 35 U.S.C. 154(b) by 292 days.

(21) Appl. No.: 10/521,282

(22) PCT Filed: Jul. 10, 2003

(86) PCT No.: PCT/EP03/07470

§ 371 (c)(1),
(2), (4) Date: Jan. 14, 2005

(87) PCT Pub. No.: WO2004/008917

PCT Pub. Date: Jan. 29, 2004

(65) Prior Publication Data

US 2006/0022500 A1 Feb. 2, 2006

(30) Foreign Application Priority Data

Jul. 22, 2002 (DE) ..... 202 11 071 U

(51) Int. Cl.

| | |
|---|---|
| ***A61G 7/015*** | (2006.01) |
| ***A61G 7/018*** | (2006.01) |
| ***A47C 20/04*** | (2006.01) |
| ***A47C 20/08*** | (2006.01) |
| ***A47C 20/18*** | (2006.01) |
| ***B60N 2/22*** | (2006.01) |
| ***B60N 2/48*** | (2006.01) |

(52) U.S. Cl. ..... 297/362.11; 297/354.13; 297/362.14; 5/616; 5/617; 5/618

(58) Field of Classification Search ..... 297/362.11, 297/362.12, 362.14, 354.12, 354.13, 330; 5/616, 617

See application file for complete search history.

(56) References Cited

U.S. PATENT DOCUMENTS 3,083,055 A * 3/1963 Davis ..... 297/344.17

(Continued)

FOREIGN PATENT DOCUMENTS

AT 401 605 B 10/1996

(Continued)

*Primary Examiner*—David Dunn
*Assistant Examiner*—Tania Abraham
(74) *Attorney, Agent, or Firm*—Henry M. Feiereisen; Ursula B. Day

(57) ABSTRACT

A reclining element includes a pivotal backrest, a headrest, which is coupled in an articulated manner thereto, and optionally a footrest. These pivotal parts can be displaced by an electromotive adjusting device. The reclining element is so configured as to eliminate the need for the link lever fastened to the pivot shaft, whereby the forces required for adjusting can be transmitted by an appropriate kinematic system to the footrest or backrest. In order to raise the backrest, an articulated lever (20) is used, which is provided in the form of a toggle lever and which is connected to the adjusting element. A lever (20*a*) of the articulated lever (20) is coupled to the adjusting element (18). The other lever (20*b*) is coupled to the backrest (11) so that when the adjusting element travels out of the end position, the joint (21) executes a guided linear movement and a rotational movement that leads to a blocking of the articulated lever (20) in a particular blocking position. A preferred embodiment of the reclining element is a slatted frame.

18 Claims, 3 Drawing Sheets

U.S. PATENT DOCUMENTS

| | | | | | |
|---|---|---|---|---|---|
| 3,191,990 | A * | 6/1965 | Rugg et al. | 297/83 |
| 4,540,165 | A * | 9/1985 | Green et al. | 5/618 |
| 5,280,999 | A * | 1/1994 | Jones et al. | 297/361.1 |
| 5,306,073 | A * | 4/1994 | Rees | 297/362.14 |
| 5,584,082 | A * | 12/1996 | Crawford et al. | 5/86.1 |
| 5,640,730 | A * | 6/1997 | Godette | 5/618 |
| 5,829,077 | A * | 11/1998 | Neige | 5/618 |
| 5,884,970 | A * | 3/1999 | Howard | 297/362.14 |
| 6,343,392 | B1 * | 2/2002 | Becker et al. | 5/618 |
| 6,945,131 | B2 * | 9/2005 | Dewert | 74/25 |
| 6,961,971 | B2 * | 11/2005 | Schneider et al. | 5/618 |
| 7,017,439 | B2 * | 3/2006 | Schunke et al. | 74/469 |
| 2004/0103476 | A1 * | 6/2004 | Barcesat | 5/618 |

FOREIGN PATENT DOCUMENTS

| | | | |
|---|---|---|---|
| CH | 490 053 | A | 5/1970 |
| DE | 94 12 497 | U1 | 11/1994 |
| DE | 296 20 699 | U1 | 3/1997 |
| DE | 297 14 299 | U1 | 12/1997 |
| EP | 79998 | A1 * | 6/1983 |
| EP | 0 315 588 | A | 5/1989 |
| FR | 2 799 107 | A | 4/2001 |
| GB | 1 578 141 | A | 11/1980 |
| WO | WO 02/24034 | A | 3/2002 |

* cited by examiner 12
28
27
23
25
20b
11
24
10
22
18
20
31
16
22
21
26

RECLINING ELEMENT

BACKGROUND OF THE INVENTION

The invention relates to a reclining element having a swingable backrest, a headrest, which is hingedly coupled thereto, and an optional footrest, with these swingable components being movable by an electromotive adjustment device including at least one drive motor and a profiled element, preferably a threaded spindle, which is operated by the drive motor, and at least one adjusting element placed upon the threaded spindle and moveable in length direction of the threaded spindle.

The reclining element involved here may be a slatted frame, a recliner, a bed or the like. The backrest and the headrest are swingable according to a preferred embodiment by a so-called dual drive. This dual drive is equipped with one or two drive motors which operate the spindle at reduced rotation speed via screw mechanisms. Control is realized by a control unit and a hand switch. Each spindle nut acts upon a link lever which is firmly attached on the pivot axis of the headrest and/or footrest.

It is also conceivable, although hardly implemented in practice, to adjust either only the backrest or the headrest. This requires only one drive which is equipped with a drive motor and a spindle and a spindle nut. According to a variation, it would also be possible to use two such drives for adjustment of the backrest and the footrest. In many designs of reclining elements involved here, the backrest is articulated to the headrest at the side distal to the footrest. Respective fittings ensure a lifting of the headrest relative to the backrest, when the drive motor and the drive associated to the backrest is switched on.

The drives involved here have been proven in practice and ensure reliable operation. However, in particular manufacturers of slatted frames and the commerce perceive the projection of the link levers, which are firmly secured to the pivot shafts, in relation to the lower surfaces of the length rods of the slatted frame as disadvantageous because it complicates stacking capability. Considered especially disadvantageous is the substantial increase in height required for stacking as a result of the link lever or link levers.

Still another drawback is also the projection of the functional fittings, required for adjustment of the backrest and the headrest, in relation to the lower surfaces of the length rods of the slatted frames. It is known that the structural height of a slatted frame is relatively slight so that the provision of a lever system is not possible between the areas bounded by the upper and lower surfaces of the slatted frame. Such a version would have been, however, ideal. Forces and moments required for adjustment are relatively great so that lever systems are required which constitute essentially a transmission.

A standard reclining element is subdivided in functional groups a) wooden frame and reclining construction, b) fitting components for the reclining construction including hinges, fitting components for stiffening the overall construction and generation of movement patterns and into the drive.

SUMMARY OF THE INVENTION

The invention is based on the object, also optionally through modification of the afore-mentioned functional groups, to so configure a reclining element of the afore-described type as to be able to eliminate the need for interfering link levers, and to allow transmission of forces required for adjustment through provision of an appropriate kinematic system from drive motor or drive motors onto the footrest and/or backrest.

The posed object is attained by connecting an articulated lever, acting like a toggle lever, for lifting the backrest. The principle of a toggle lever is generally known. Both levers are single-armed levers and interconnected via the toggle or joint. The one free end of the lever is connected to a fixed bearing whereas the free end of the second lever executes a linear movement, when a force is applied on the toggle or joint. In the present case, the articulated lever is also comprised of the two single-armed levers and the toggle. The particularity is the securement of one free end of one lever to the backrest so that the latter can execute a movement, when the free end of the other lever is moved by the adjusting element traveling on the spindle. The force applied on the joint is thus derived in the particular configuration by the movement of the adjusting element. To create optimum force conditions, it is provided to link one lever of the articulated lever to the adjusting element and to link the other lever to the backrest, and to have the joint execute during travel of the adjusting element from the end portion a guided linear movement and a rotational movement to block the articulated lever in a particular angular position of the lever. The joint executes a linear movement which follows in synchronism the movement of the adjusting element. Thus, a torque is applied by the lever, articulated to the adjusting element, upon the joint. Overall, the arrangement is so configured that from the time instance of travel of the adjusting element from the end position up to a blockage of the articulated lever the backrest is pivoted in such a position as to swing to an angular position from the most unfavorable extended disposition despite the application of relatively small forces. As a consequence of the blockage of the articulated lever in a predetermined angular position of the two single-armed levers, a more beneficial position is established with respect to force application in order to lift the backrest. After blockage, the articulated lever acts like a rigid angle lever. In order to realize a rotational movement for the joint during the linear movement, the securement of a fixed guide pin thereto is provided which is so supported on a stationary guideway during movement of the joint as to allow the backrest to pivot into the more beneficial position with respect to force application. The moment required for rotating the joint can easily be realized when the guide pin is offset in relation to the point of articulation in the direction to the backrest. Although the resultant lever arm is relatively small as a consequence of the structural conditions, it is sufficient to initially lift the backrest by a small acute angle. According to a further embodiment, it is provided to support the lever, secured to the backrest, on a crossbar connecting the side portions. During lifting of the backrest, this crossbar undergoes a movement which can be exploited to drive a bar linkage for pivoting the headrest. This bar linkage is suitably a crank mechanism. The articulated lever in conjunction with the crank mechanism is so configured that the pivoting movement of the headrest leads the pivoting movement of the backrest. When the headrest assumes the end position, more effective to more optimal conditions are realized for the articulated lever to adjust the backrest. As a result, the force required for adjusting the backrest is smaller. In a most simple manner, each crank mechanism includes a crank, which is supported on the associated side portion of the backrest, and a connecting rod linked to the headrest and connected to the crank. The crank may also be designated as double crank in view of the advantageous configuration as a double-armed lever, whereby the connecting rod, which is articulated to the headrest, is secured to one lever arm, and whereby the crossbar, which interconnects the other two lever arms and is provided for articulation of the articulated lever, is secured to the other two lever arms. Thus, the rotational movement of the two cranks is derived in a most simple manner by one element. According to a preferred embodiment, the lever arms of the crank are of same length. The connecting rods are advantageously linked to brackets which are securely fixed to the side portions of the headrest. As a consequence, the points of articulation of both connecting rods can be placed in vertical offset relationship so that a sufficient force is available when the headrest begins to pivot.

The reclining element is further equipped with a footrest which is advantageously formed of two footrest elements hingedly connected to one another which are oriented at an angle to one another in the extended disposition. The footrest element facing away from the backrest supports hereby guide links which are linked with the other ends to the length rods of the reclining element. Associated to the footrest is also a threaded spindle for attachment of an adjusting element which can travel in longitudinal direction. Articulated to this adjusting element is a pushup lever which swings the footrest elements when the adjusting element travels from the end position.

BRIEF DESCRIPTION OF THE DRAWING

The invention will now be explained in more detail with reference to the attached drawings, in which.

DETAILED DESCRIPTION OF PREFERRED EMBODIMENTS

Figure 1:
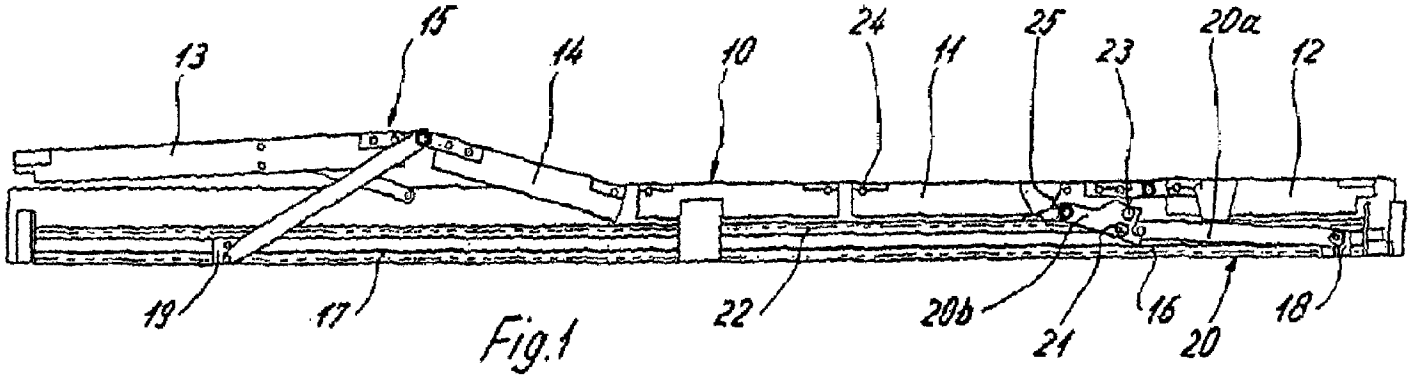
FIG. 1 shows a reclining element according to the invention with reclined backrest and reclined headrest.
Figure 2:
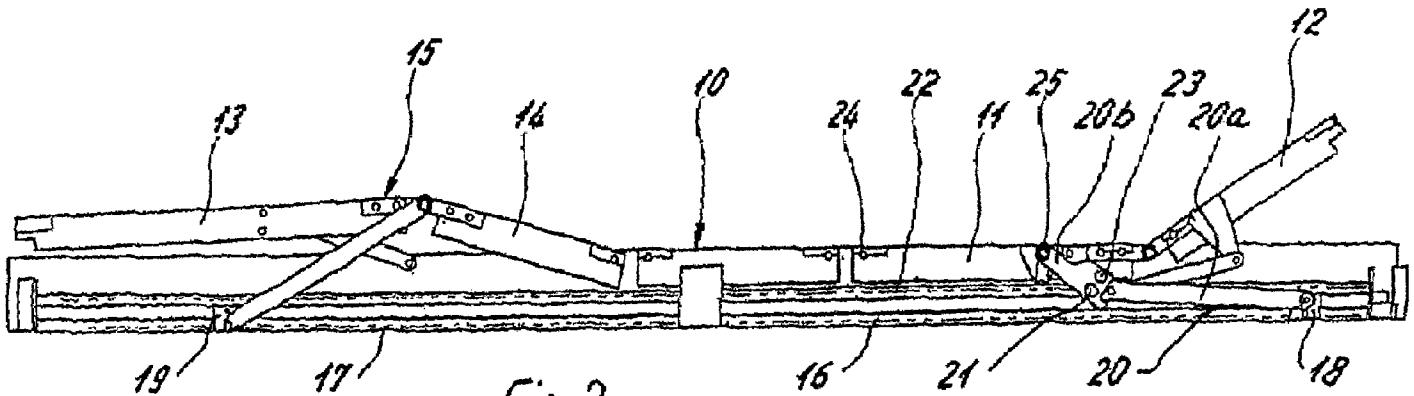
FIG. 2 shows the reclining element according to FIG. 1 with extended headrest.
Figure 3:
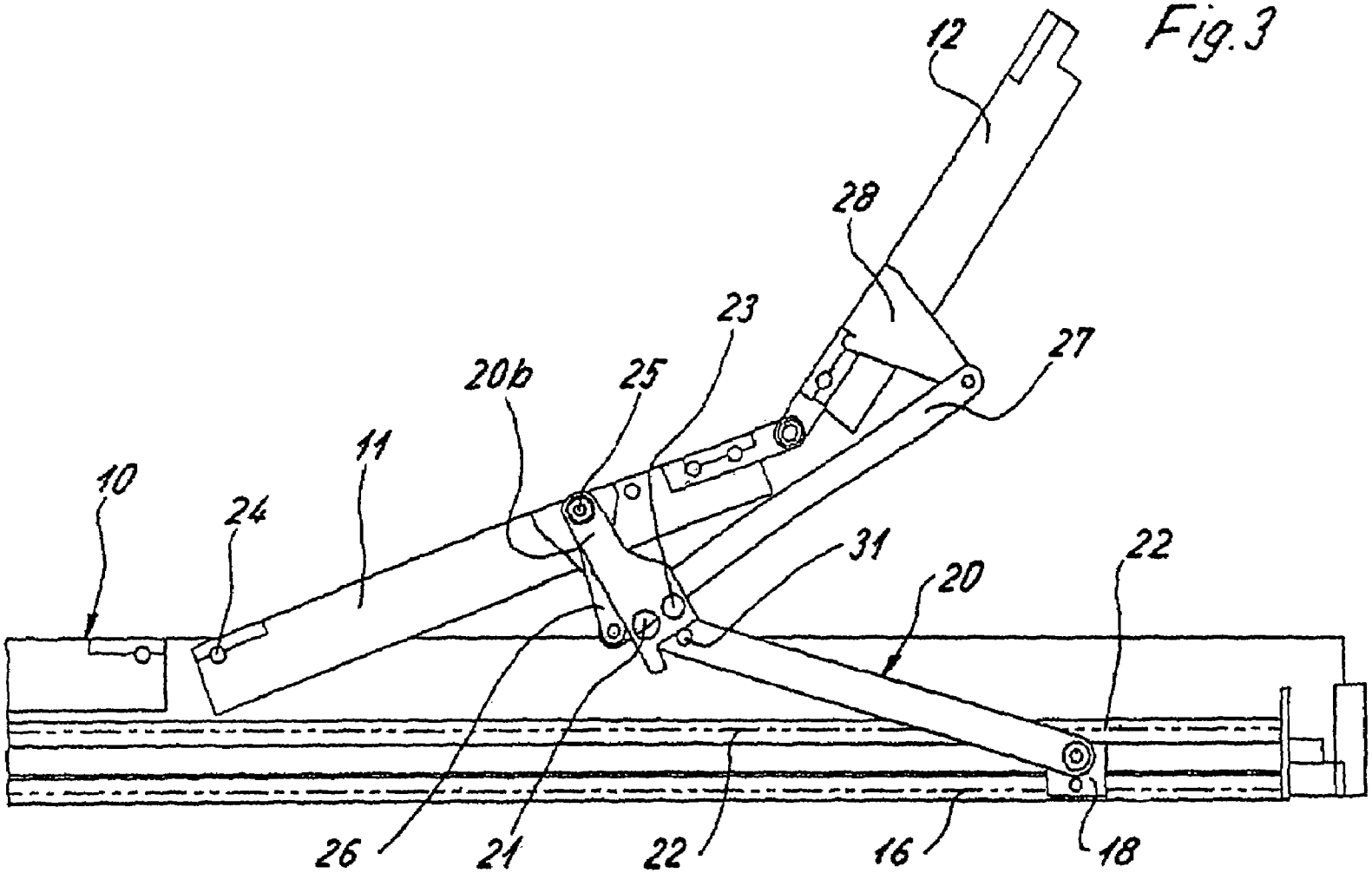
FIG. 3 shows a partial view of the reclining element with elevated backrest.
Figure 4:
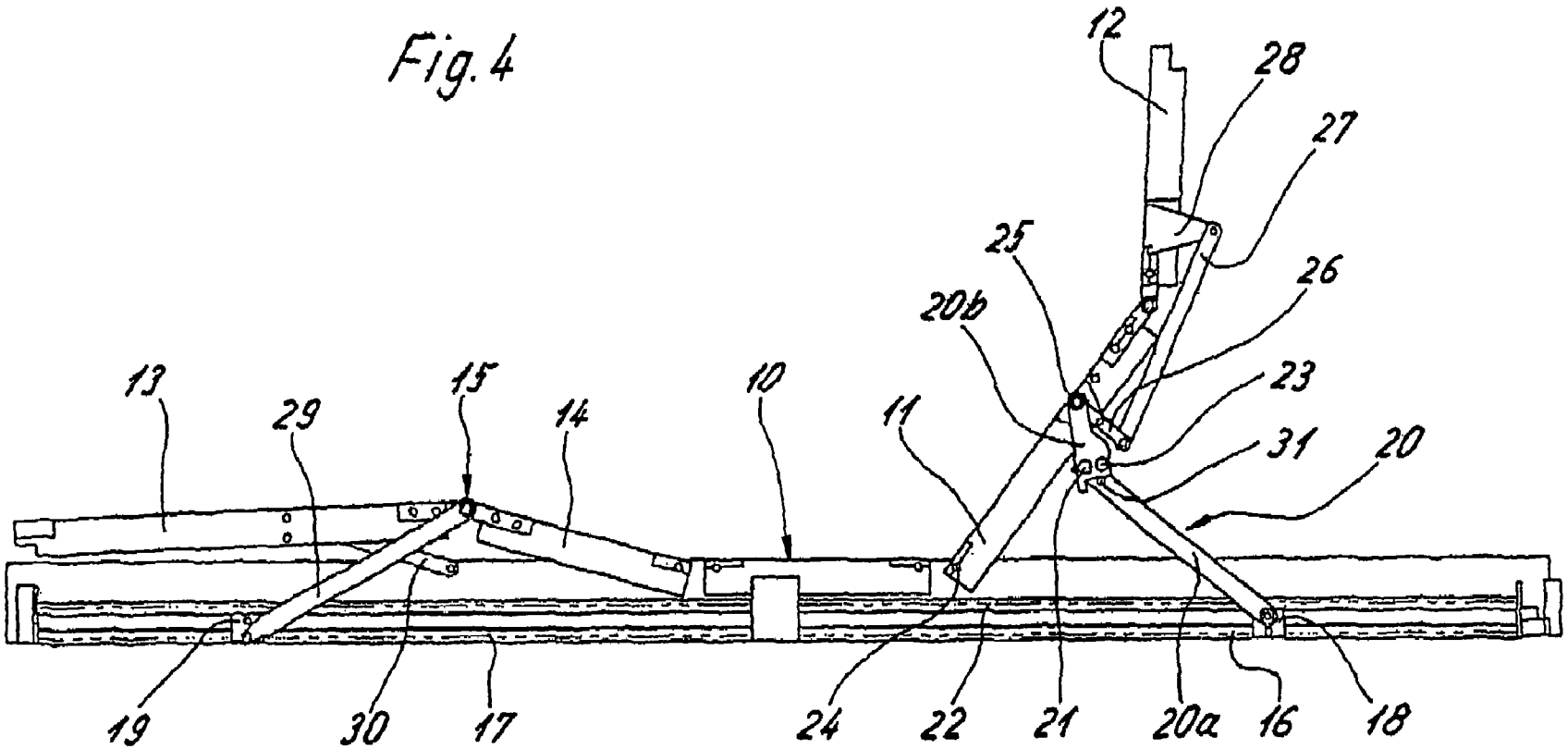
FIG. 4 shows the reclining element according to the FIGS. 1 to 3 with still further extended backrest.

The reclining element 10, illustrated in the Figures, is configured as slatted frame which is equipped with a backrest 11 and a headrest 12 which is hingedly coupled to the backrest. Moreover, the reclining element 10 is equipped with a footrest 15 formed of two footrest elements 13, 14. Further, the reclining element 10 is equipped with two threaded spindles 16, 17 extending in longitudinal direction and arranged in midsection between the side portions of the reclining elements 10. Each threaded spindle 16, 17 is operated by a drive motor. Placed on each threaded spindle 16, 17 is an adjusting element 18, 19 which is secured against rotation and moves in longitudinal direction of the threaded spindle 16 and 17, respectively, when the threaded spindle rotates. When the backrest 11 and the headrest 12 assumes the reclined disposition, as shown in FIG. 1, the associated adjusting element 18 is located in the outer end zone of the threaded spindle 16. Linked to the threaded spindle 16 is an articulated lever 20 which is comprised of two single-armed lever arms 20*a* and 20*b*. The two levers are hingedly connected to one another by a pin 21 in a manner not described in detail. The reclining element 10 is moreover equipped with a stationary slideway 22 which is arranged in parallel relationship to the threaded spindles 16, 17. Provided on the lever 20*b*, coupled with the backrest 11, is moreover a guide pin 23 which is operated in a manner still to be described in more detail. The pivot axis of the backrest 11 is designated by reference character 24. The lever 20*b* is connected to a crossbar 25 which is supported with its ends in the side portions of the backrest 11. The headrest 12 is adjusted by two lateral crank mechanisms in a manner still to be described in more detail. Two cranks 26 are hereby supported on the side portions of the backrest 11 and interconnected via connecting rods 27 with the headrest 12. The ends of the connecting rods 27, which are distal to the crossbar 25, are linked to brackets 28. Supported on the adjusting element 19 for the footrest 15 is a pushup lever 29 whose other end is articulated to the joint axis of both footrest elements 13, 14. The footrest element 13, which is distal to the backrest 11, has laterally articulated thereto two guide links 30 whose other ends are articulated to the side portions of the reclining element 10. In the extended position, shown in FIGS. 1, 2, 4 and 5, the footrest elements 13, 14 are oriented at an angle to each other. For illustrative reasons, the Figures depict the footrest in partially extended disposition. To move the backrest 11 and the headrest 12 up, the motor operating the spindle 16 is first switched on. The adjusting element 18 travels in the direction of the pivot axis 24 of the backrest 11. In this position, the guide pin 23 slides on the upper surface of the slideway 22. The lever 20*b*, which is linked to the backrest 11, is pivoted about the longitudinal center axis of the hinge pin 21. As a result, the backrest 11 is slightly raised. The movement causes also the cranks 26 to pivot. As a consequence, the crank mechanism is caused to operate and the headrest 12 is lifted until impacting an unillustrated stop on the backrest 11. Subsequently, the backrest 11 is slight elevated. The headrest 12 executes thus a leading movement in relation to the backrest 11. Subsequently, the backrest 11 is further raised until the articulated lever 20 is blocked and acts like a rigid lever. In the illustrated exemplified embodiment, the lever 20*a*, which is linked to the adjusting element 18*a*, is hereby provided with a stop 31 which is impacted by the area of the lever 20*b*, which area faces the adjusting element 18. The extended position of the headrest 12 is shown in FIG. 2. As a result of its slight elevation, the backrest 11 extends at a small acute angle to the horizontal. This results in optimum lever ratios for the further upward movement of the backrest 11. Upon further travel in the direction of the pivot axis 24 of the backrest 11, the adjusting element 18 is pivoted to the end position shown in FIG. 4, whereby the position of the headrest 12 remains unchanged. Retraction of the backrest 11 is realized in reverse manner.

According to a further embodiment not shown in detail, the threaded spindles 16, 17 are operated by a motor. The transmission to reduce the motor speed includes coupling elements which enable to respectively connect only one of the threaded spindles 16, 17 or both together via the transmission with the motor. Contrary to the illustration, the guide pin 23 and the joint 21 may also be arranged in concentric superimposed relationship.

The invention is not limited to the illustrated exemplified embodiment. Essential is the blockage of the articulated lever 20, which is connected to the adjusting element 18, from a particular position onward of the adjusting element 18 and the backrest 11, respectively, and its operation as a rigid lever. It is further relevant that the backrest 11 pivots during or after the leading pivot movement of the headrest 12 so that the required force is decreased for the subsequent complete extension of the backrest 11. Overall, the arrangement of the components used for adjusting the backrest 11 and the headrest 12 should be so configured that no components project out in relation to the upper and lower areas of the reclining element 10, when the backrest 11 and the headrest assume their reclined disposition.

What is claimed is:

1. A reclining element, comprising:

a swingable backrest;

a headrest hingedly connected to one end of the backrest;

an electromotive adjustment device for moving the backrest and the headrest, said adjustment device including at least one profiled element, a drive motor for operating the profiled element, and at least one adjusting element placed upon the profiled element for movement in a longitudinal direction of the spindle profiled element between two end positions; and an articulated lever having first and second levers with confronting ends of the levers hingedly connected by a joint, wherein one of the first and second levers is linked to the adjusting element and the other one of the first and second levers is connected to the backrest for raising the backrest when the adjusting element moves from one of the end positions to the other one of the end positions, wherein a leading movement of the headrest causes a slight lifting of the backrest, and wherein a further lifting of the backrest causes a blockage of the articulated lever so that the articulated lever acts like a rigid lever.

2. The reclining element of claim 1, and further comprising a footrest hingedly connected to another end of the backrest, said adjustment device being operatively connected to the footrest for moving the footrest between an extended position in which the footrest is flat and a raised position.

3. The reclining element of claim 1, wherein the profiled element is a threaded spindle.

4. The reclining element of claim 1, wherein a movement of the adjusting element from the one end position causes the joint to execute a guided linear movement and a rotational movement that leads to the blockage of the articulated lever when the first and second levers assume a particular disposition relative to one another.

5. The reclining element of claim 4, and further comprising a fixed guide pin which is provided in an area of the joint and so supported during the rotational movement of the joint on a stationary slideway that the backrest is swingable to assume a position of optimum lever ratio to facilitate a continuous raising of the backrest.

6. The reclining element of claim 5, wherein the guide pin is disposed in offset relationship to the joint.

7. The reclining element of claim 6, wherein the guide pin is positioned in closer relationship to the backrest than the joint, when the adjusting element is in the one end position.

8. The reclining element of claim 6, wherein the guide pin and the joint are positioned at substantially same vertical height, when the adjusting element reaches the other end position.

9. The reclining element of claim 5, wherein the guide pin and the joint are arranged in spaced-apart superimposed relationship.

10. The reclining element of claim 4, wherein the first lever is provided with a fixed stop constructed to effect the blockage of the articulated lever and impacted by a joint proximal area of the second lever, when the first and second levers assume the particular angular disposition.

11. The reclining element of claim 1, and further comprising a crossbar for connecting opposite side portions of the backrest, said second lever being supported on the crossbar.

12. The reclining element of claim 1, and further comprising at least one crank mechanism for swinging the headrest in response to a movement of the adjusting element.

13. The reclining element of claim 12, and further comprising a crossbar for connecting opposite side portions of the backrest, wherein the crank mechanism includes a crank supported on the side portions of the backrest and having one end connected to the crossbar, and a connecting rod having one end articulated to another end of the crank.

14. The reclining element of claim 13, and further comprising a bracket fixedly secured to a side portion of the headrest and provided for articulation of an end of the connecting rod at a distance to the crossbar.

15. The reclining element of claim 1, wherein the headrest moves against a stop of the backrest for causing the backrest to be raised slightly.

16. The reclining element of claim 1, and further comprising two of said profiled element, said two profiled elements being driven by the drive motor which is so constructed as to allow operation of one of the profiled elements or both profiled elements.

17. The reclining element of claim 16, wherein the drive motor is a geared motor.

18. The reclining element of claim 1, wherein the first and second levers are single-armed levers.

* * * * *